US007726079B2

(12) United States Patent
Raineri

(10) Patent No.: US 7,726,079 B2
(45) Date of Patent: Jun. 1, 2010

(54) MEANS FOR DEHUMIDIFICATION, PERSPIRATION, VENTILATION OR THE IMPERMEABILIZATION OF WALLS, FLOORS AND/OR CEILINGS

(76) Inventor: Gabriele Raineri, Via Giuseppe Bonaventura, 3, Randazzo (CT) (IT) I-95036

( * ) Notice: Subject to any disclaimer, the term of this patent is extended or adjusted under 35 U.S.C. 154(b) by 153 days.

(21) Appl. No.: 11/664,617

(22) PCT Filed: Sep. 29, 2005

(86) PCT No.: PCT/IT2005/000563

§ 371 (c)(1),
(2), (4) Date: Apr. 4, 2007

(87) PCT Pub. No.: WO2006/038240

PCT Pub. Date: Apr. 13, 2006

(65) Prior Publication Data

US 2007/0256378 A1 Nov. 8, 2007

(30) Foreign Application Priority Data

Oct. 6, 2004 (IT) ..... RM2004A0481

(51) Int. Cl.
*E06B 7/14* (2006.01)

(52) U.S. Cl. ..... 52/209

(58) Field of Classification Search ..... 52/302.3, 52/281, 282.1, 287.1, 845, 209
See application file for complete search history.

(56) References Cited

U.S. PATENT DOCUMENTS 606,348 A * 6/1898 Kuhne ..... 52/355
1,609,541 A * 12/1926 Gooding ..... 52/834
3,120,031 A * 2/1964 Bohnsack ..... 52/241
3,310,926 A * 3/1967 Brandreth et al. ..... 52/481.1
3,738,083 A * 6/1973 Shimano ..... 52/584.1
4,147,001 A * 4/1979 Oliver ..... 52/284
4,258,519 A * 3/1981 Hugens ..... 52/282.1
4,689,930 A * 9/1987 Menchetti ..... 52/277
4,999,961 A * 3/1991 McNary ..... 52/287.1
5,117,601 A * 6/1992 Habicht ..... 52/281
5,152,113 A * 10/1992 Guddas ..... 52/238.1
5,243,799 A * 9/1993 Schluter ..... 52/282.1
5,647,181 A * 7/1997 Hunts ..... 52/282.1
6,006,480 A * 12/1999 Rook ..... 52/309.12
D421,133 S * 2/2000 Mandell ..... D25/61
6,173,547 B1 * 1/2001 Lipson ..... 52/582.1
6,298,609 B1 * 10/2001 Bifano et al. ..... 52/58

(Continued)

FOREIGN PATENT DOCUMENTS

DE 26 06 353 8/1977

(Continued)

*Primary Examiner*—Richard E Chilcot, Jr.
*Assistant Examiner*—Andrew J Triggs
(74) *Attorney, Agent, or Firm*—Young & Thompson

(57) ABSTRACT

A device for the dehumidification, perspiration, ventilation or impermeabilization of walls, floors and/or ceilings by the use of a double fretted membrane of the known type, the shape of which defines longitudinal channels, characterized in that there is provided a peripheral section having a tubular body from which two pairs of longitudinal ribs perpendicular to each other and extending all over the length of the section project. Each pair of ribs is able to receive a peripheral edge of the double membrane.

13 Claims, 4 Drawing Sheets

U.S. PATENT DOCUMENTS

| | | | | |
|---|---|---|---|---|
| 6,631,598 | B2 * | 10/2003 | Raineri | 52/385 |
| 6,758,017 | B2 * | 7/2004 | Young | 52/255 |
| 7,159,370 | B2 * | 1/2007 | Oliphant et al. | 52/845 |
| 2002/0124501 | A1 * | 9/2002 | Raineri | 52/287.1 |
| 2005/0072083 | A1 * | 4/2005 | Bauer | 52/390 |

FOREIGN PATENT DOCUMENTS

| | | |
|---|---|---|
| EP | 0771585 | 5/1996 |
| FR | 2451427 | 10/1980 |
| GB | 2388852 | 11/2003 |
| WO | 02/22986 | 3/2002 |

* cited by examiner

MEANS FOR DEHUMIDIFICATION, PERSPIRATION, VENTILATION OR THE IMPERMEABILIZATION OF WALLS, FLOORS AND/OR CEILINGS

The present invention relates to building industry, and more particularly the dehumidification, perspiration, ventilation to the outside or impermeabilization of walls and/or floors and/or ceilings.

According to the invention, there is provided the use of a double fretted membrane of the known type, typically used for laying floors and/or coatings of any kind and their possible quick removal, together with a suitable peripheral section able to allow the dehumidification or the ventilation of the buildings to which the double membrane is secured. Of such two membranes, that are fitted each other by their frets, the first membrane is in contact with the building and the second with plaster or coating or floor.

Double fretted membranes of plastic material in the name of the same Applicant are known. They allow the dehumidification to be carried out by dispersing the humidity at the peripheral areas of the floor and/or walls by the longitudinal channels formed by the frets, i.e. to the inside of the room where such frets are installed.

A first problem of such membranes is that the rooms where the membrane are applied can show an insufficient change of air, thus giving rise to inside humidity stagnation.

A second problem bound to the re-circulating air is that any gas such as radon (which is radioactive) propagates to the inside room through walls and/or floors, especially in case they consists of tuff bricks releasing radon particles to the inside room.

A third problem is that the membranes themselves cannot easily be used to provide waterproofing as necessary for terraces and pools.

The main object of the present invention is to overcome such problems by providing a section able to cooperate with at least a double fretted membrane, which section allows the humidity and/or any radioactive gas to be conveyed directly to the outside, thus avoiding their propagation to the inside room as well as creating a circulation of air that allows an efficient dehumidification and perspiration of the bottom of floors, walls and ceilings coated by such double membrane.

According to the invention, this is accomplished by a section provided with a hollow body having two pairs of longitudinal ribs, each of them being able to receive a peripheral edge of a double fretted membrane.

A better understanding of the present invention will result from the following detailed description with reference to the accompanying drawings that show some preferred embodiments thereof only by way of example. In the drawings.

Figure 5:
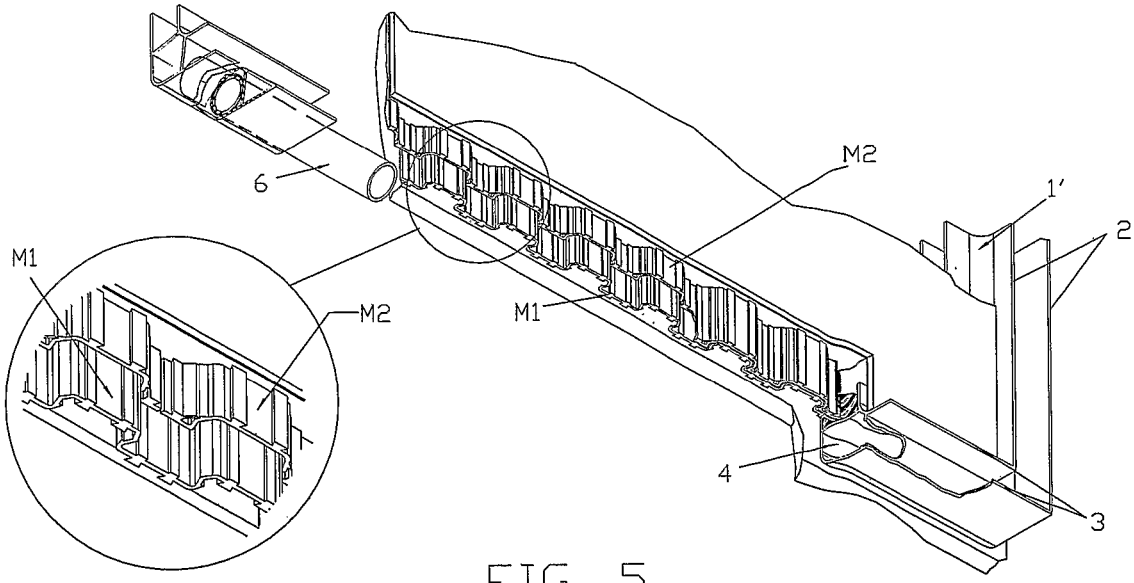
Figure 6A:
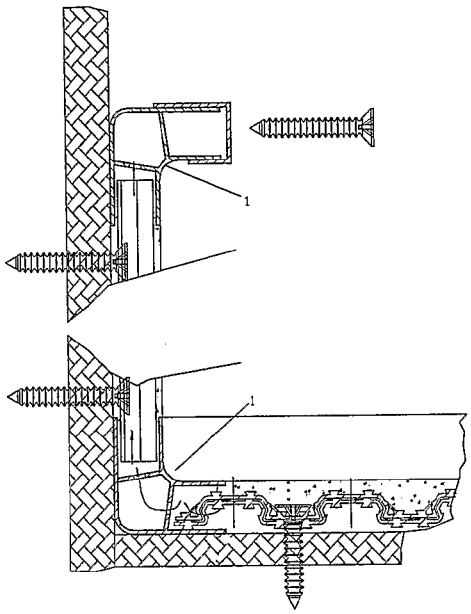
Figure 6B:
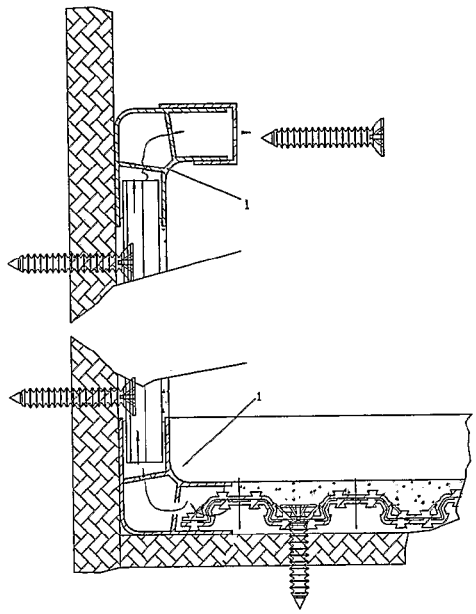
Figure 7A:
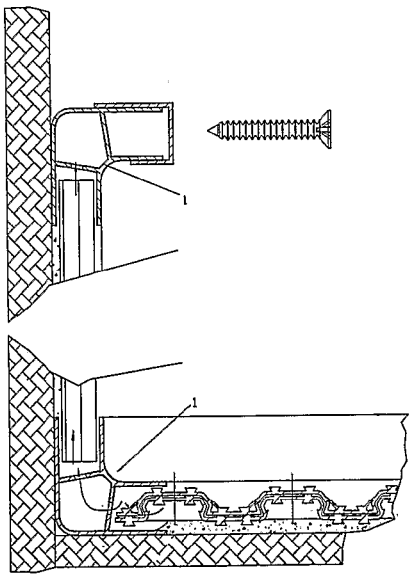
Figure 7B:
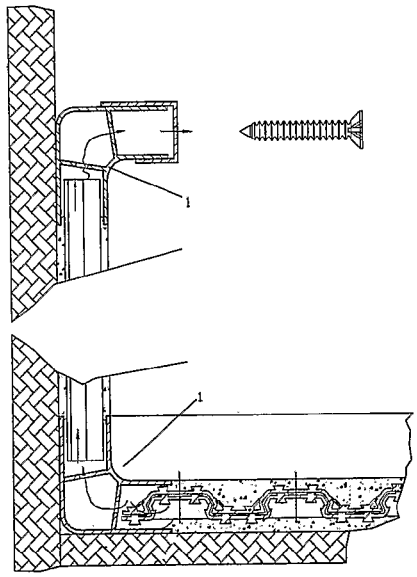
Figures 8A, 8B:
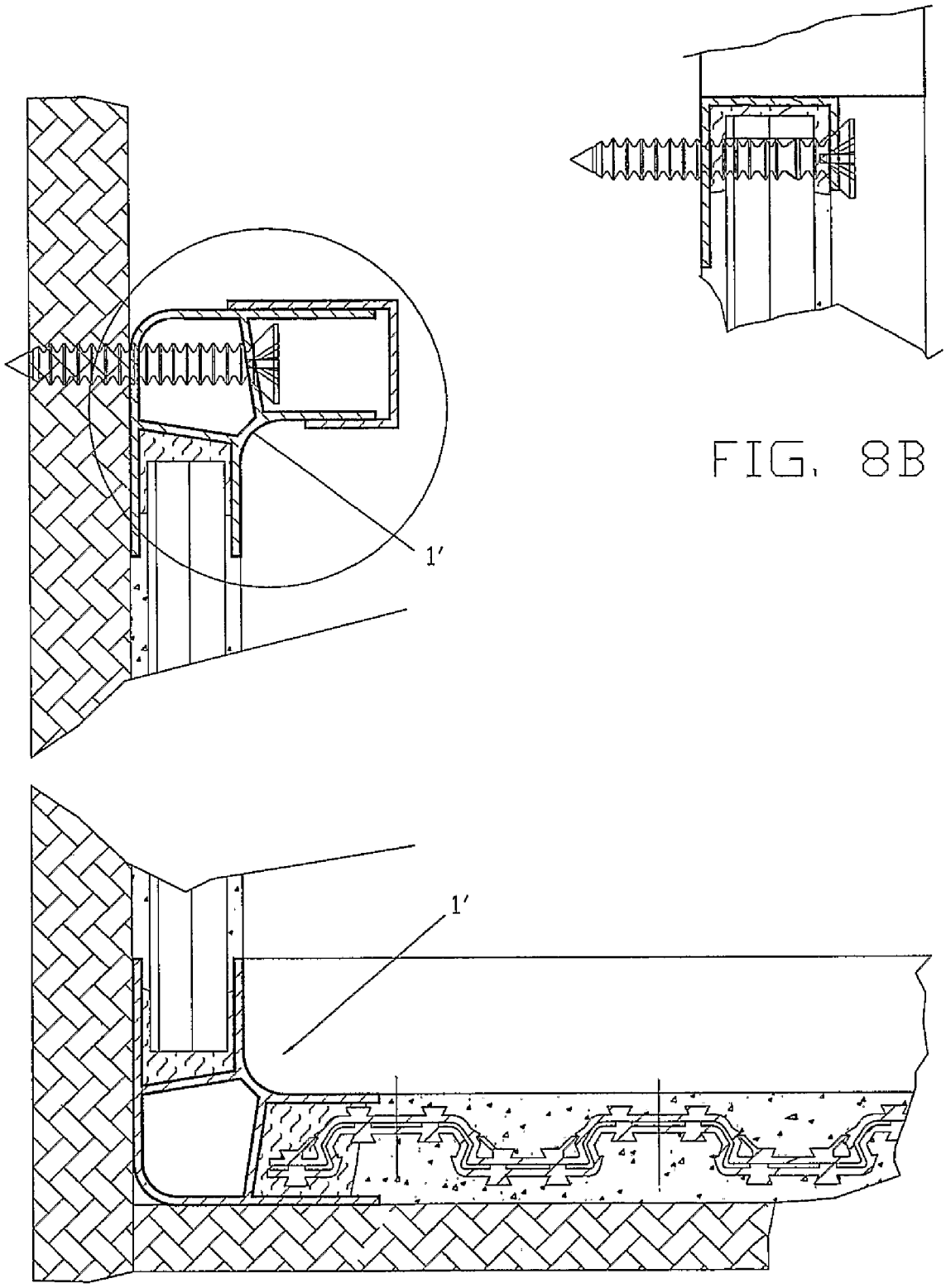

FIG. 5, similar to the preceding figure, relates to a second embodiment of the invention and shows also the connecting system between two sections according to the invention during the installation;

FIGS. 6A and 6B are cross sections of the finding installed without glue to ceilings with ventilation to the outside and the inside, respectively;

FIGS. 7A and 7B, similar to the preceding figures, show the installation by glue;

FIG. 8A is a cross section of a second embodiment of the finding;

FIG. 8B shows a variation relative to the upper cover member of the section of the preceding figure.

With reference to FIGS. 1 to 4, peripheral section 1, preferably of plastic material, has a tubular body 4 from which two pairs of longitudinal ribs 2 and 3 project, each pair of ribs 2 and 3 being perpendicular to the other and each rib extending all over the length of section 1.

The distance between the free ends of the ribs of each pair 2 and 3 is preferably lower than that of their feet.

In any case, the distance between the free ends is lower than or equal to the thickness of the double fretted membranes M1 and M2 so that the insertion of the edge of said double membranes occurs with a little interference.

According to a peculiar feature of the finding, in order to dehumidify the surface of a building to which the double membranes M1 and M2 are applied, the section is provided with longitudinally distributed, side holes 7 causing the humidity and/or and gases collected by such double membranes inside tubular body 4 of the section to pass. In this case, it is convenient that first membrane M1 is laid by a restricted amount of glue to keep free the recesses of the fret directed to the building and providing the above-mentioned channels C.

Figure 3A:
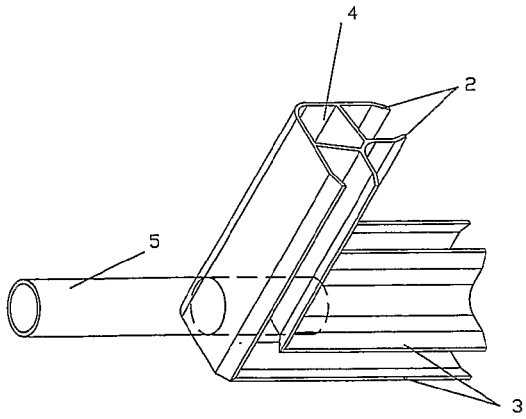
FIGS. 3A and 3B show the assembling of the finding for the ventilation to the outside.
Figure 3B:
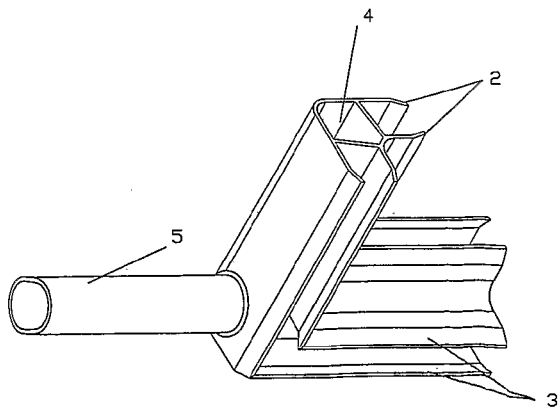
Figure 4:
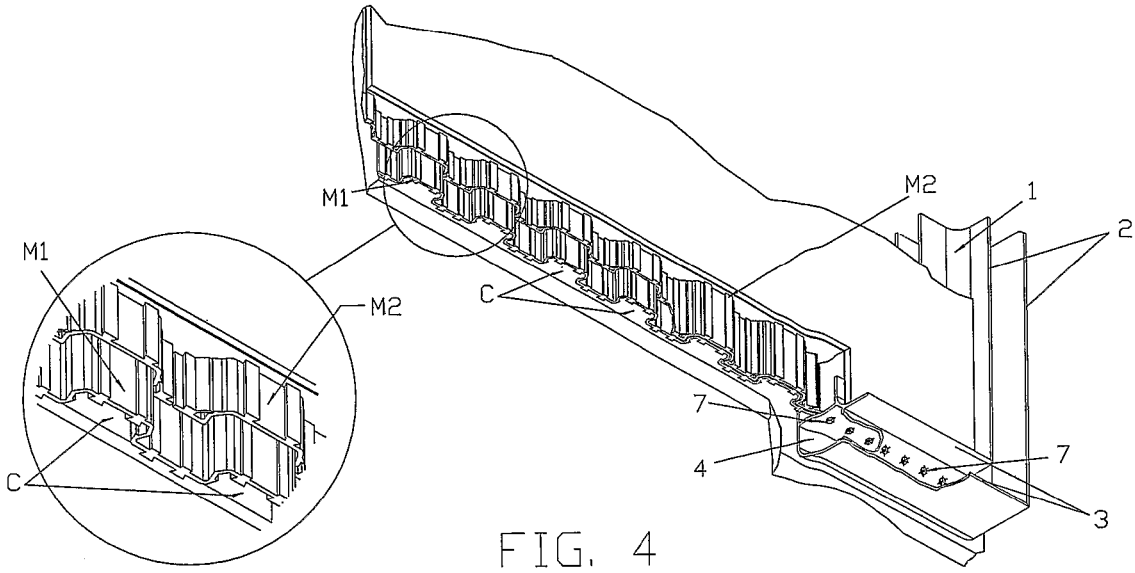
FIG. 4 is a three-dimensional, partially cross-sectioned view of the first embodiment of the finding.

Such side holes 7 are positioned at channels C of fretted membranes M1 and M2 inserted between the ribs of section 1, thus providing that the humidity and/or the gas in channels C enters tubular body 4 of peripheral section 1 through holes 7 to come then out to the outside through a piping or conduit 5 arranged to connect at least one of the two ends of tubular body 4 of section 1 to the outside (FIGS. 3A and 3B).

To this end, it should be appreciated that plaster or coating or floor laid on second membrane M2 prevents the humidity and/or gas from propagating to the room through the same holes 7 of section 1 (FIGS. 6A and 7A).

Advantageously, such end piping 5 connected to the outside also helps air to re-circulate, particularly by a forced ventilation.

If humidity is not excessive, it is also possible to disperse it to the room, thus avoiding in any case the formation of mould on the walls and/or the detachment of the coating or plaster (FIGS. 6B and 7B).

Figure 1:
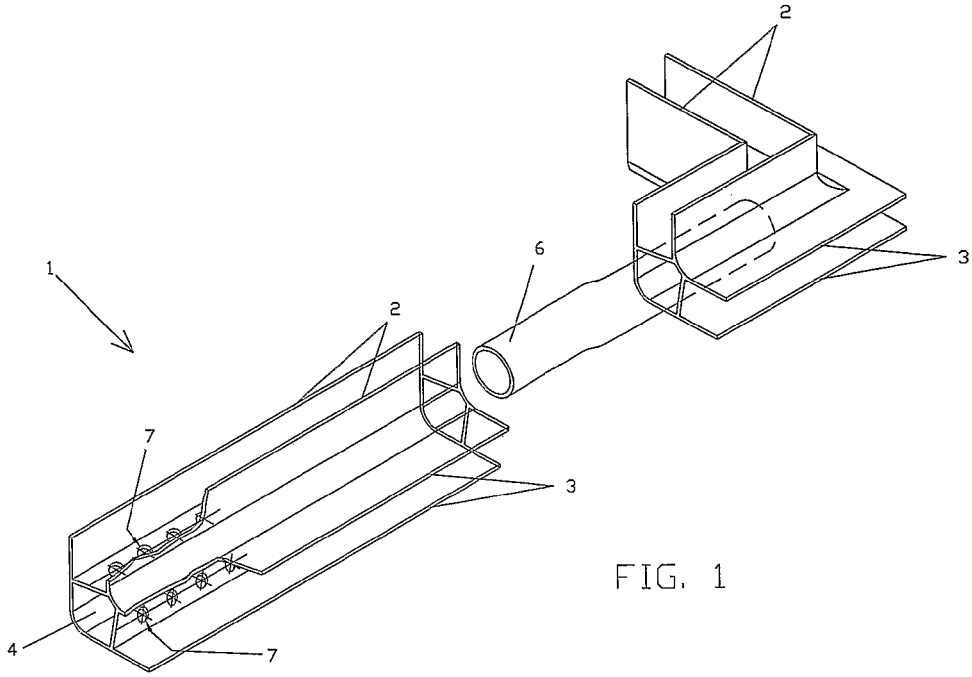
FIG. 1 is three-dimensional diagram of a first embodiment of the finding.
Figure 2:
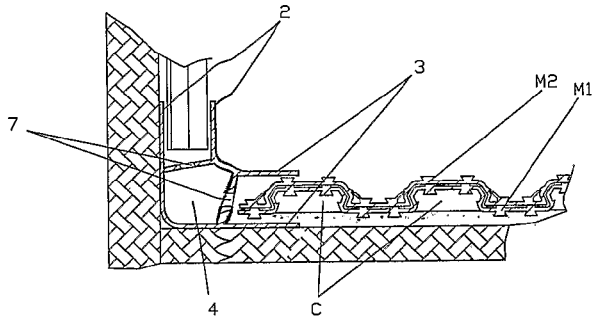
FIG. 2 is a cross section of the finding of FIG. 1 installed together with two double fretted membranes.

According to the invention, to connect two adjacent sections 1 upon laying down, a length of pipe 6 running along the ends of sections 1 is inserted inside and connect the latter, thus restoring the continuity of their tubular bodies 4 (FIG. 1).

Thus, to guarantee a firm fastening of sections 1, connecting pipe 6 is glued to the sections and can also be perforated at side holes 7 of section 1.

It is self-evident that connecting pipe 6 on which the two sections 1 slide has lower outside dimensions than the inside dimensions of tubular body 4 of sections 1 so that such pipe is fitted therein by sliding coupling.

In a second embodiment shown in FIGS. 5 and 8A, 8B, to provide the waterproofing of the room coated by the double fretted membranes M1 and M2, a second type of peripheral section indicated at 1' without the side holes disclosed above is provided.

Moreover, to guarantee the maximum sealing each double fretted membrane M1 and M2 is secured to such section without holes 1' by glue or a sealing means of the known type so as to fill any room between the peripheral edge of channels C of double membranes M1 and M2 and the inside of the pairs of ribs 2 and 3 of section 1' between which such double membranes are fitted.

It should be appreciated that according to an advantageous embodiment of the invention it is also possible to lay down a double membrane on a floor just by laying first membrane M1 on the bottom or the floor below without securing it and by gluing only the new tiles to the upper membrane M2.

Likewise, as far as the walls is concerned, the double membranes can be secured only by expansion dowels and then a coating or plaster is applied to second membrane M2 by usual methods.

The present invention has been described and illustrated according to some preferred embodiments thereof, however, it should be understood that those skilled in the art can make equivalent modifications and/or replacements without departing from the scope of the present industrial invention.

The invention claimed is:

1. A means for the dehumidification, perspiration, ventilation or impermeabilization of walls, floors and/or ceilings by the use of a double fretted membrane (M1, M2), the shape of which defines longitudinal channels (C), characterized in that there is provided a peripheral section (1) having a tubular body 4 from which two pairs of longitudinal ribs (2, 3) perpendicular to each other and extending all over the length of section (1) project, each pair of ribs (2, 3) being able to receive a peripheral edge of the double membrane (M1, M2), and characterized in that in order to dehumidify and/or to cause the surface of a building to which the double membrane (M1, M2) is applied to perspire, the section (1) is provided with side holes (7) longitudinally distributed between each pair (2, 3) of the ribs, characterized in that once the double fretted membrane (M1, M2) is inserted between the pairs of ribs (2, 3), said side holes (7) are positioned at channels (C) of double membrane (M1, M2) so that the humidity and/or any gas in said channels enters tubular body (4) of section (1) through holes (7) to come then out to the outside through a piping or conduit (5) arranged to connect at least one of the two ends of tubular body (4) of section (1) to the outside, thus providing a ventilation of the building directly to the outside.

2. The means according to claim 1, characterized in that first membrane (M1) is laid by a restricted amount of glue to keep free the recesses of the fret directed to the building and providing channels (C).

3. The means according to claim 1, characterized in that to provide the waterproofing of the building member to which the double fretted membrane (M1, M2) is applied, another peripheral section (1') without side holes is provided to which the double fretted membrane (M1, M2) is secured by glue or a sealing means so as to fill any room between peripheral edges of channels (C) of double membrane (M1, M2) and the inside of the pairs of ribs (2, 3) of section (1') between which said double membrane is fitted.

4. The means according to claim 1, characterized in that connecting pipe (6) is perforated at side holes (7) of section (1).

5. The means according to claim 1, characterized in that first membrane (M1) is laid by a restricted amount of glue to keep free the recesses of the fret directed to the building and providing channels (C).

6. The means according to claim 1, characterized in that connecting pipe (6) is perforated at side holes (7) of section (1).

7. A means for the dehumidification, perspiration, ventilation or impermeabilization of walls, floors and/or ceilings by the use of a double fretted membrane (M1, M2), the shape of which defines longitudinal channels (C), characterized in that there is provided a peripheral section (1) having a tubular body 4 from which two pairs of longitudinal ribs (2, 3) perpendicular to each other and extending all over the length of section (1) project, each pair of ribs (2, 3) being able to receive a peripheral edge of the double membrane (M1, M2), and characterized in that to connect two adjacent sections (1) upon laying down, a length of pipe (6) running along the ends of sections (1) is inserted therein, thus restoring the continuity of tubular bodies (4).

8. The means according to claim 7, characterized in that connecting pipe (6) on which the two sections (1) slide has lower outside dimensions than the inside dimensions of tubular body (4) of sections (1) so that such pipe is fitted into said sections (1) by sliding coupling.

9. The means according to claim 8, characterized in that connecting pipe (6) is perforated at side holes (7) of section (1).

10. The means according to claim 7, characterized in that connecting pipe (6) on which the two sections (1) slide has lower outside dimensions than the inside dimensions of tubular body (4) of sections (1) so that such pipe is fitted into said sections (1) by sliding coupling.

11. The means according to claim 7, characterized in that connecting pipe (6) is perforated at side holes (7) of section (1).

12. A means for the dehumidification, perspiration, ventilation or impermeabilization of walls, floors and/or ceilings by the use of a double fretted membrane (M1, M2), the shape of which defines longitudinal channels (C), characterized in that there is provided a peripheral section (1) having a tubular body 4 from which two pairs of longitudinal ribs (2, 3) perpendicular to each other and extending all over the length of section (1) project, each pair of ribs (2, 3) being able to receive a peripheral edge of the double membrane (M1, M2), and characterized in that to guarantee a firm fastening of sections (1), a connecting pipe (6) is glued to the sections.

13. The means according to claim 12, characterized in that connecting pipe (6) is perforated at side holes (7) of section (1).

* * * * *